United States Patent [19]

Neyret

[11] 4,224,020

[45] * Sep. 23, 1980

[54] MAXIMUM-FLAME-HEIGHT PRESSURE REGULATOR FOR GAS LIGHTER

[75] Inventor: Guy Neyret, Francheville, France

[73] Assignee: Etablissements Genoud & Cie Societe Anonyme Dite, Venissileux, France

[ * ] Notice: The portion of the term of this patent subsequent to Jul. 18, 1995, has been disclaimed.

[21] Appl. No.: 860,845

[22] Filed: Dec. 15, 1977

Related U.S. Application Data

[63] Continuation-in-part of Ser. No. 692,729, Jun. 4, 1976, Pat. No. 4,101,262.

[30] Foreign Application Priority Data

Jun. 5, 1975 [FR] France ..... 75 18161

[51] Int. Cl.[3] ..... F23D 13/04

[52] U.S. Cl. ..... 431/344; 210/508

[58] Field of Search ..... 431/130, 131, 142, 143, 431/150, 254, 276, 277, 344; 210/508, DIG. 26

[56] References Cited

U.S. PATENT DOCUMENTS

| | | | |
|---|---|---|---|
| 3,165,908 | 1/1965 | Kihara | 431/131 X |
| 3,418,821 | 12/1968 | Remy et al. | 431/344 X |
| 3,471,246 | 10/1969 | Piffath et al. | 431/150 |
| 3,589,851 | 6/1971 | Rabe | 431/131 |
| 3,597,140 | 8/1971 | Rabe | 431/131 |
| 3,663,152 | 5/1972 | Yoshida | 431/150 X |
| 3,705,785 | 12/1972 | Goto | 431/344 |
| 3,794,583 | 2/1974 | Rhodes | 210/DIG. 26 |
| 3,854,862 | 12/1974 | Webster | 431/276 X |
| 3,867,090 | 2/1975 | Gili | 431/254 X |
| 3,895,905 | 7/1975 | Nissen | 431/277 X |
| 3,966,392 | 6/1976 | Lockwood | 431/277 X |
| 4,060,202 | 11/1977 | Neyret | 431/344 X |
| 4,101,262 | 7/1978 | Neyret | 434/344 |

*Primary Examiner*—Samuel Scott
*Assistant Examiner*—G. Anderson
*Attorney, Agent, or Firm*—Karl F. Ross

[57] ABSTRACT

A pressure regulator for a gas lighter which comprises, in a well of the lighter body, a porous membrane of constant natural porosity separating two chambers from one another to set the maximum flame height. A downstream chamber is connected to the burner outlet and serves for evaporation while upstream of the filter, the wetting chamber communicates with the reservoir containing the fuel, e.g. via a wick.

11 Claims, 4 Drawing Figures

MAXIMUM-FLAME-HEIGHT PRESSURE REGULATOR FOR GAS LIGHTER

CROSS REFERENCE TO RELATED APPLICATION

This application is a continuation-in-part of Ser. No. 692,729 filed June 4, 1976, now U.S. Pat. No. 4,101,262 issued July 18, 1978.

FIELD OF THE INVENTION

The present invention relates to a pressure regulator for gas lighters.

BACKGROUND OF THE INVENTION

Whether or not they are provided with means for regulation by the user, lighters are always provided with at least one pressure-regulating filter which limits the height of the flame to a value less than the maximum height considered tolerable in accordance with safety requirements. This pressure-regulating filter is made from a porous material such as fibers or foam and means are provided for regulating the compression of this filter depending on the desired maximum rate of flow, during assembly of the pressure regulator. These means are constituted either by screwed together threaded members which become inaccessible after assembly of the lighter, or by abutments or the like limiting the travel of tools for assembling and/or fitting the parts constituting the pressure regulator, or by abutments limiting the movement of the key for regulating the lighter.

OBJECT OF THE INVENTION

The present invention intends to simplify the construction and assembly of these pressure regulators and consequently to reduce the cost price thereof.

SUMMARY OF THE INVENTION

To this end, the pressure regulator comprises, at least one filter constituted by a porous membrane having good wettability with regard to hydrocarbons, held between two chambers, an upstream wetting chamber and a downstream evaporation chamber and whose porosity characteristics correspond to the maximum desired rate of flow depending on the desired height of flame.

Materials which are quite suitable for forming this filter are polyolefins of molecular structure and in particular polypropylene or polyethylene.

When the valve is opened, the pressure which prevails upstream of the membrane tends to deform the latter and press it against the wall of the base of the evaporation chamber.

In order to prevent this deformation from resulting in a reduction of the useful surface of the membrane to a value corresponding to the section of the gas outlet channel, according to another feature of the invention, there is associated with the membrane at least one fibrous layer placed on its downstream side.

Preferably, in order to prevent any consequences of inserting the membrane in the wrong direction, two fibrous layers are provided, each of which is fixed to one of the sides of the membrane.

Each fibrous layer is advantageously fixed by sticking or welding to said face of the membrane.

According to a practical embodiment of the invention, the filter is housed in a cavity provided to receive it in the lower end of the valve body and in the base of which the evaporation chamber is provided and it is fitted in this cavity with the interposition of a support member in which a wetting chamber for the filter is provided, adjacent the membrane.

Advantageously, the valve body is made from a material which is a good heat conductor, in order to facilitate the transfer of heat from the burner-valve member to the evaporation chamber whereas the support washer for the membrane is made from a material which is a non conductor or poor conductor of heat in order to prevent the evaporation of the liquefied gas upstream of the membrane.

In the case where it is desired to provide adjustment of the height of the flame by the user, there is provided in the base of the hole serving as a housing for the valve and pressure regulator, a filter of conventional type, i.e. of fibrous material or foam, against which the base of the valve body bears directly, the latter being mounted by screwing it in the hole which serves as a housing for the latter and its upper end being provided with an actuating wheel, the porosity characteristics of the porous membrane thus corresponding to the maximum flame height.

Preferably, in this case, the wetting chamber has a large cross section, improving the wetting conditions of the membrane and a slight depth keeping its volume at the smallest possible value, in order to prevent the accumulation of too great a quantity of liquefied gas between the filter and the membrane, when the valve is closed. At the time of lighting, one thus eliminates the initial formation of a large flame which immediately decreases to the value predetermined by the adjustment made to the filter by the user.

The term "membrane" as used herein is intended to be limited to the scientific or technical definition of this flexible member as distinguished from a porous web or body which is not a membrane. The membrane can be of the type described in CHEMICAL AND PROCESS TECHNOLOGY ENCYCLOPEDIA, McGraw Hill Book Co., New York, 1974 (page 726 ff). There it is pointed out that a membrane is distinguishable from a screen by the fact that a screen will block particles of a particle size of $4\times10^{-2}$ mm or greater while a membrane will not pass particles having a particle size greater than $5\times10^{-3}$ mm. While particles are not involved in the present case, this has been pointed out to simplify the distinction between a membrane, of the type used in the present invention, and screens, grids, fabrics or other porous bodies which may be applied from time to time in the lighter air for filtering and other purposes.

The membrane is thus semipermeable in the sense that it permits only the passage of certain substances but prevents the passage of others and, under these circumstances, various critical characteristics of the membrane can be outlined. Thus it may be noted that the membrane must be wettable by the liquid fuel which consists of butane or contains a major proportion of butane. Advantageously the membrane should only be permeable to the fuel in the liquid or gaseous state at a pressure differential across the membrane of 0.5 to 5 atm. Naturally, the membrane will also be permeable to the fuel at higher pressures but the same are irrelevant from a practical viewpoint. In other words, the pressure of the fuel on the reservoir side of the membrane should be between 1.5 and 6 atm. (absolute).

The total effective (gas-passing) flow cross-section of the membrane exposed to the chamber at the burner side thereof should be that which corresponds to a circular bore of a diameter of 4 to 50 microns. The larger cross-section is employed when only a gaseous fuel is used while the smaller cross-section applies where the liquid is delivered to the membrane, e.g. by a wick as is usually the case in a butane lighter.

The porosity of the membrane is preferably 30 to 50%, i.e. 30 to 50% of the volume of the membrane can consist of pores and each pore may have a transverse dimension of, say, 0.02 to 0.2 microns. Reference is made here to a transverse dimension because, in practice, the pores seldom are of circular cross-section and hence reference to a diameter may be illusory. For example, a preferred diaphragm is a sheet or foil of polypropylene which has been stretched to fibrillation, i.e. a degree of molecular orientation such that the molecules extending in the stretch direction break their cross-linking bonds in part and form slots parallel to the direction of extension. These slots may have a transverse dimension of 0.02 microns although they can be somewhat longer, say 10 times this transverse dimension.

It has also been found that the diameter of the compartment at the reservoir side (wetting chamber) of the membrane is important for good flame height limitation, this compartment having a diameter of 1.6 to 2.7 mm. The depth of the compartment at the reservoir side of the membrane has also been found to be important and should be approximately 0.2 mm, this is not critical (i.e. the depth can be greater).

With the membrane as described above, it is possible to manufacture by mass production extremely large numbers of cigarette lighters with practically precisely determined maximum flame height—or normal flame height—at the level desired and far less than the maximum flame height heretofore accepted as the level which must be tolerated if large numbers of mass-produced lighters are not to be discarded.

BRIEF DESCRIPTION OF THE DRAWING

Nevertheless, the invention will be better understood by means of the ensuing description, referring to the accompanying diagrammatic drawing, in which.

SPECIFIC DESCRIPTION

Figure 1:
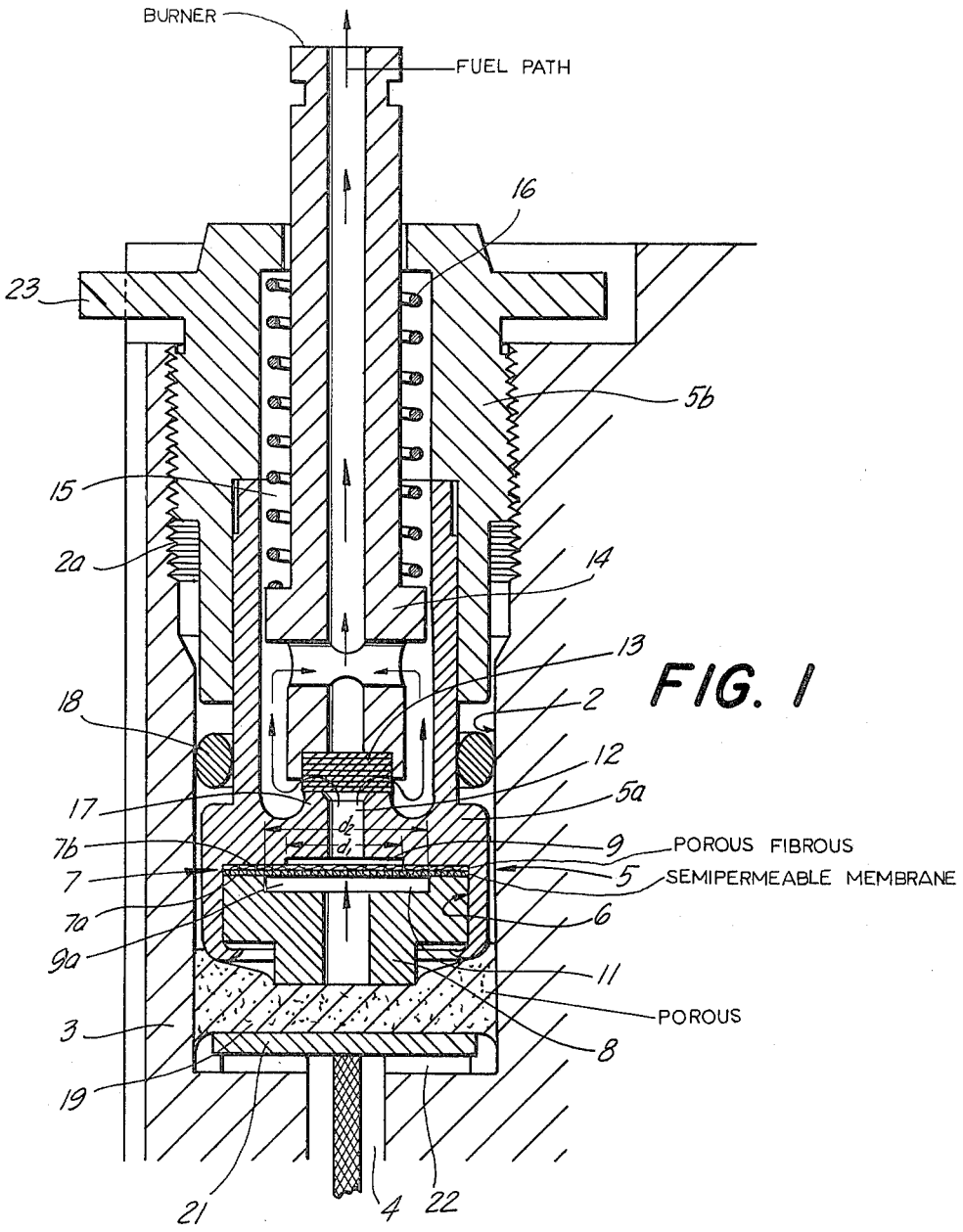
FIG. 1 is an axial cross-sectional view which illustrates a valve for a gas lighter provided with a pressure regulator according to the invention, as a non-limiting example.

The valve is housed in a hole or well 2, provided to receive the latter in the body 3 of the lighter and connected to the reservoir by a channel 4.

Provided at the lower end of the valve body 5 is a cavity 6 intended to receive the pressure regulator according to the invention.

As shown in the drawing, this pressure regulator comprises a filter 7 pressed against the base of the cavity 6 by a support member 8 in turn fitted in said cavity.

Provided in the base of the cavity 6 is a cylindrical chamber 9 located downstream of and in part defined by the filter 7 and constituting an evaporation chamber and provided in the side of the member 8 bearing against the filter 7 is another cylindrical chamber 11 of larger diameter than the chamber 9 located upstream of the filter 7 and intended to facilitate wetting of the latter by the liquefied gas.

According to the invention, the filter 7 is constituted by a porous membrane *7a* (on the side of wetting chamber 11) having good wettability with regard to hydrocarbons, and a fibrous and thus also porous layer *7b* on the upper or evaporation-chamber side.

The porosity of the porous membrane *7a* is chosen in order to obtain a maximum rate of flow of gas corresponding to a flame height for current use. When a variable flame height is used, the maximum should correspond to the maximum of the adjustment range.

The selection of maximum height from one style of lighter to another can be made simply by varying the contact surface of member 8 against the membrane to vary the exposed cross section of the membrane, i.e. the area permeable to the fuel.

Materials which are perfectly suitable for forming this filter are polyolefins of molecular structure and in particular polypropylene and polyethylene.

Figure 2:
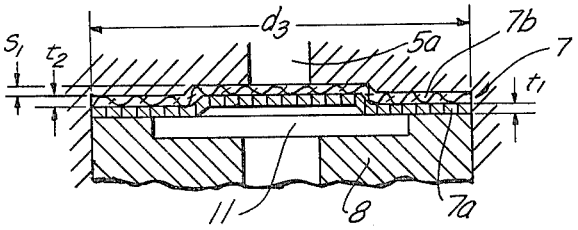
FIG. 2 is a detail view of the assembly in use.

The presence of the fibrous layer *7b*, which is advantageously fixed by sticking or welding to the corresponding side of the membrane *7a*, has the effect of providing a passage for the fuel through the evaporation chamber, even when, under the effect of the pressure prevailing upstream of the filter 7, the latter is pressed against the base of the evaporation chamber 9 (See FIG. 2). In fact, without the presence of the layer *7b*, the effect of the deformation of the membrane *7a* would be that only its part located in the region of the channel 12 would be used.

As can be seen from FIG. 1, the valve body formed with the chamber 9 has an axially open recess *9a* and a shoulder surrounding the recess against which the membrane *7a* and its fibrous covering *7b* is retained.

The channel 12 is normally kept closed by a sealing rubber washer 13 supported by a piston valve 14 mounted in a cylindrical housing 15 in the valve body 5 and constantly acting on which is the spring 16 intended to keep it in the closed position. This spring could be outside the valve.

A valve seat 17 is provided in the base of the cylindrical housing 15 at the outlet of the channel 12.

An annular gasket 18 ensures a seal between the valve body 5 and the hole 2 serving as a housing for the latter.

The advantage of using a porous membrane *7a* as the pressure regulator in a valve of a gas lighter is that it requires no adjustment when it is assembled, since the rate of flow corresponding thereto depends solely on the pressure prevailing in the lighter reservoir and on its porosity characteristics. It also makes it possible to eliminate devices for limiting the flame height, which are outside the valve.

To facilitate the assembly of this lighter valve, the membrane *7a* is preferably fixed by sticking or welding to the support member 8. To prevent any assembly errors, it is clearly possible to cover the two sides of the membrane diaphragm *7a* with a porous layer *7b*.

Figure 3:
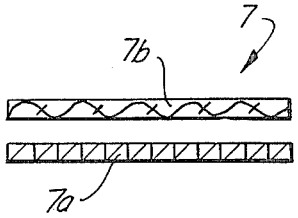
FIG. 3 is an exploded view thereof.

In FIG. 3 of the drawing, the membrane *7a* has been illustrated as a perforated sheet in order to facilitate the description. Naturally, this illustration must be considered as greatly simplified since it is in fact a semipermeable membrane of the type described with elongated pores which can be formed by stretching of polypropylene foil until fibrillation as mentioned above. The diameter $d_1$ of the chamber 9 is advantageously 1.5 mm and the depth $s_1$ about 0.2 mm. The thickness $t_1$ can be about 0.2 mm or less and the porosity of the membrane between 30 and 50% pores. The thickness $t_2$ of the fiber layer can correspond to that of the membrane and the diameter $d_2$ of the lower chamber 11 may be between 1.6 and 2.7 mm, a larger diameter being preferably used for smaller membrane porosity. The diameter of the membrane can be about 3–4.5 mm±0.2, varying again inversely with porosity.

As in numerous currently known lighters, the burner is provided at the upper free end of the valve 14. According to another feature of the invention, in order to ensure a good transfer of heat between the burner and the evaporation chamber 9 for liquefied gas, with a view of promoting this evaporation, the valve body is made from a material which is a good heat conductor and in particular of metal.

On the other hand, according to another feature of the invention, so that there is no danger of causing evaporation of the liquefied gas in the wetting chamber 11, the support member 8 is made from a material which is non-conductor or poor conductor of heat, such as plastic (synthetic-resin) material.

For the purpose of facilitating the manufacture of this valve, while providing a support region for the spring 16 of the valve 14, the valve body 5 is made in two coaxial cylindrical parts and is force-fitted, namely a lower part 5*a* and an upper part 5*b*.

In the drawings, and although this is not indispensable in the framework of the present invention, a valve facilitating adjustment of the flame height by the user has been shown. For this reason, apart from the pressure regulator 7, there is provided in the base of the hole 2, below the valve 5, a filter 19 of traditional type, i.e. of fibrous material or foam, passed by the valve body 5 against a support washer 21, below which are provided radial passages 22 for the liquefied gas coming from the channel 4.

Furthermore, the upper part 5*b* of the valve body 5, is firstly mounted by screwing in the hole 2, whose upper end is provided with a screwthread 2*a* and secondly, is provided with a ring 23 serving as a drive wheel.

By acting on this wheel 23, the user may thus compress the filter 19 to a greater or lesser extent and reduce the gas flow to a greater or lesser extent.

In this case, the function of the pressure regulator 7 is to limit the maximum height of the flame to a value less than or equal to a safe value. Thus, even if the user completely decompresses the filter 8, the flame will never exceed the height corresponding to the rate of flow determined by the characteristics of the membrane 7*a* of the pressure regulator 7.

It will be noted that the dimensions of the wetting chamber 11 located downstream of the filter 19 are of very reduced volume, which eliminates the accumulation of too great a quantity of liquefied gas downstream of the filter 19 and consequently, upon opening the valve 14, the formation of a large flame whose height corresponds to the rate of flow of the membrane 7*a* independent of the adjustment previously made by the user, by compressing the filter 19. At the time of ignition, one thus eliminates the annoyance of obtaining a large flame whose height decreases immediately to the value corresponding to the regulation of compression of the filter 19. The fuel flow path is shown in dot-dash lines.

Figure 4:
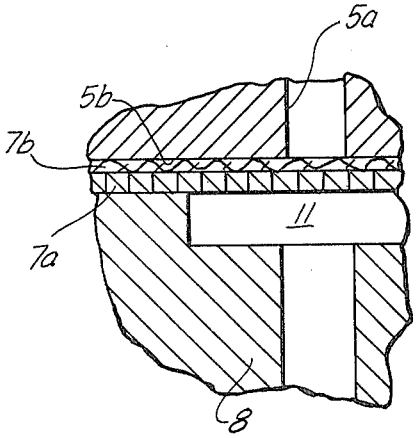
FIG. 4 is a view similar to FIG. 2 illustrating another embodiment of the invention.

In the modification of FIG. 4, the evaporating chamber is omitted, as a recess in the face 5*b* of member 5, the function of this chamber being replaced by the interstices of the fiber layer 7*b* bonded to the semipermeable membrane 7*a*.

I claim:

1. In a gas lighter containing a reservoir of a gasifiable liquid fuel, a burner for producing a flame by combustion of said fuel and means establishing a flow passage for said fuel from said reservoir to said burner, the improvement which comprises a maximum flame height regulator spanned across said passage and consisting of a semipermeable membrane wettable by the liquid fuel, means defining a wetting chamber along said passage between said reservoir and said membrane, means between said membrane and said burner defining an evaporation space, said chamber being spanned by said membrane, said membrane being permeable to the liquid fuel as well as to gas formed therefrom and having fixed porosity characteristics determined at the time of its manufacture to establish the maximum height of said flame and invariable during assembly and use of the lighter, and means bearing upon the periphery of said membrane to define an effective area traversed by fuel and less than the total area of the membrane, said means bearing upon said periphery including two members sandwiching said membrane between them and clamped together for insertion as an assembly into the lighter.

2. The improvement defined in claim 1 wherein 30 to 50% of the volume of said membrane is constituted by pores.

3. The improvement defined in claim 2 wherein said space is an evaporation chamber defined along one side thereof by said membrane and of a depth in the direction of said burner of about 0.2 mm and a diameter of about 1.5 mm.

4. The improvement defined in claim 3 wherein said wetting chamber is axially aligned with said evaporation chamber and has a larger diameter than said evaporation chamber.

5. The improvement defined in claim 4 wherein the diameter of said wetting chamber is substantially 1.6 to 2.7 mm.

6. The improvement defined in claim 1 wherein the total pore cross-section of said membrane corresponds in area to the cross-section of a circular bore having a diameter of 4 to 50 microns.

7. The improvement defined in claim 1 wherein said membrane is constructed of a material such that it will only pass said fuel upon application of a pressure differential of at least 0.5 atm.

8. The improvement defined in claim 1 wherein said membrane is composed of fibrillated polypropylene formed with elongated pores having a transverse dimension of about 0.02 microns.

9. The improvement defined in claim 1, further comprising at least one fiber layer disposed along a side of said membrane and separating same from a respective one of said chambers, said fiber layer being coextensive with said membrane and having fuel-passing interstices between fibers.

10. The improvement defined in claim 9 wherein said layer is disposed between said membrane and said burner to define said space within the interstices of said fiber layer.

11. The improvement defined in claim 1, further comprising a valve member disposed along said passage and spaced from said membrane between said space and said burner and selectively actuatable to permit and block the passage of fuel therethrough.

* * * * *